US007509070B2

(12) United States Patent
Rummler

(10) Patent No.: US 7,509,070 B2
(45) Date of Patent: Mar. 24, 2009

(54) DEVICE AND METHOD FOR SPOOLING A CARTRIDGE TONER SEAL

(75) Inventor: Craig Rummler, Redondo Beach, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 246 days.

(21) Appl. No.: 11/732,928

(22) Filed: Apr. 5, 2007

(65) Prior Publication Data

US 2008/0247775 A1 Oct. 9, 2008

(51) Int. Cl.
*G03G 15/08* (2006.01)

(52) U.S. Cl. ..... 399/109; 399/111

(58) Field of Classification Search ..... 399/13, 399/27, 102, 103, 106, 107, 109, 111, 119, 399/120

See application file for complete search history.

(56) References Cited

U.S. PATENT DOCUMENTS 6,445,893 B2 * 9/2002 Hashimoto et al. ..... 399/106
7,212,765 B2 * 5/2007 Lewis et al. ..... 399/109
7,231,164 B2 * 6/2007 Harada et al. ..... 399/106
7,277,659 B2 * 10/2007 Kobayashi et al. ..... 399/106

* cited by examiner

*Primary Examiner*—Hoan H Tran
(74) *Attorney, Agent, or Firm*—Roland Tong

(57) ABSTRACT

A method of remanufacturing a seal spooling mechanism of a printer cartridge, the printer cartridge defining a seal passage, the seal passage providing access to a toner port of the cartridge to be covered by a toner seal, the seal spooling mechanism including a spool where a first toner seal may be wound, the seal spooling mechanism further including a spool frame where the spool may be mounted, the method including detaching the spool frame from the printer cartridge; inserting a second toner seal through the seal passage; sealing the toner port with the second toner seal, the second toner seal including a toner seal extension configured to extend out of the seal passage upon sealing the toner port; winding the toner seal extension around the spool; providing a replacement spool frame, the replacement spool frame being configured to be attached to the printer cartridge at a location that is different from the location where the spool frame was previously attached on the printer cartridge; and attaching the spool to the replacement spool frame.

17 Claims, 9 Drawing Sheets

DEVICE AND METHOD FOR SPOOLING A CARTRIDGE TONER SEAL

CROSS REFERENCES TO RELATED APPLICATIONS

None

FIELD OF INVENTION

The present invention relates to electrophotography, particularly methods and apparatus for manufacturing or remanufacturing toner cartridges.

BACKGROUND

Printer cartridges typically include a toner hopper, which is configured to store toner. The toner hopper usually has a toner port where toner is drawn out during printing. Printer cartridges are typically packaged with a toner seal to prevent toner from escaping from the toner port during shipment or handling. The toner seal is typically a removable piece of material, such as plastic, which is laid and adhered to the surfaces surrounding the toner port. In some cartridges, the toner seal is removed by hand by the end user.

In some other cartridges, such as the cartridges for Hewlett Packard's HP4700 and HP9000 printer, the toner seal is removed by a seal spooling mechanism built within the printer cartridge. The seal spooling mechanism operates in a manner wherein after the printer cartridge is introduced into the proper printer, the seal is wound around a spool thereby removing it from the toner port. The toner port is consequently opened, and the toner may then be used for printing.

Used printer cartridges are often remanufactured. The remanufacturing of printer cartridges may include cleaning, repairing damaged parts, replacing worn parts, and adding toner. The toner hopper seal may be one of the worn parts replaced during remanufacturing. The new toner hopper seal may be introduced from one side of the toner hopper through a seal passage. For cartridges with seal spooling mechanisms built within the cartridge, a spool frame may block the access to the seal passage. To gain access to this blocked seal passage, re-manufacturers may break the frame bridge (reference no. 32 in FIG. 2), which connects the spool holders of the spool frame. Re-manufacturers may then remove a sealing plug and insert a new seal. One problem with this method is that the frame may break or become susceptible to breaking, as the supporting structure for the spool frame, the frame bridge, is broken. As a result, the re-manufactured seal spooling mechanism may not properly work, or the remanufacturing may not be completed without finding a replacement frame. Another problem with the existing method is that it does not provide a way to secure the sealing plug after the new seal is installed. The unsecured sealing plug may detach and cause toner leak during shipment, handling, or use. Methods and devices for effectively remanufacturing cartridges with toner seal spooling mechanisms are desired and are addressed by the present invention.

BRIEF DESCRIPTION

The invention includes a method of remanufacturing a seal spooling mechanism of a printer cartridge, the printer cartridge defining a seal passage, the seal passage providing access to a toner port of the cartridge to be covered by a toner seal, the seal spooling mechanism comprising a spool where a first toner seal may be wound, the seal spooling mechanism further comprising a spool frame where the spool may be mounted, the method comprising detaching the spool frame from the printer cartridge; inserting a second toner seal through the seal passage; sealing the toner port with the second toner seal, the second toner seal comprising a toner seal extension configured to extend out of the seal passage upon sealing the toner port; winding the toner seal extension around the spool; providing a replacement spool frame, the replacement spool frame being configured to be attached to the printer cartridge at a location that is different from the location where the spool frame was previously attached on the printer cartridge; and attaching the spool to the replacement spool frame.

The invention also includes a method of minimizing leakage of toner stored in a printer cartridge, the printer cartridge comprising a toner hopper configured to store the toner, the toner hopper defining a toner port, the printer cartridge defining a seal passage substantially adjacent to and leading to the toner port, the method comprising providing a seal configured to surround the toner port; inserting the seal through the seal passage; providing a spool, the spool comprising a body around which the seal may be wound; attaching the seal to the spool; positioning a seal entry plug inside the seal passage; attaching a spool frame to the printer cartridge, the spool frame configured to rotatably hold the spool, the spool frame comprising at least one seal plug stop; positioning the seal plug stop proximate to the seal entry plug; attaching the spool to the spool frame; and configuring the spool to rotate and wind the seal when the printer cartridge is inserted in a predetermined printer, wherein the seal entry plug and the seal minimizes the toner from exiting the printer cartridge.

The invention further includes a spool frame for toner seal spooling mechanisms of printer cartridges, the toner seal spooling mechanism having a spool where a toner cartridge seal may be wound, the spool comprising a spool body, the spool body defining a first end and a second end, the spool frame comprising a first end holder configured to hold the first end of the spool body, the first end holder defining a base side and a free side; a second end holder configured to hold the second end of the spool body; the second end holder defining a base side and a free side; and a spool frame base connecting the first end holder and the second end holder, the spool frame base being attached to the first end holder and the second end holder at the respective base sides of the first end holder and the second end holder, the spool frame base not being attached to the free sides of the first end holder and the second end holder, wherein when the spool frame is attached to the printer cartridge, the seal may be pulled out of the printer cartridge.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

When a toner seal is no longer needed to cover a toner port, the toner seal can be positioned substantially away from the toner port to allow the toner to be used for printing. In some cartridges, the toner seals are removed by hand by the end user. In some cartridges, automatic spooling mechanisms are in place to eliminate requiring the end users to remove the seals by hand. The present invention includes methods and devices for automatically spooling toner seals of printer cartridges.

The present invention includes methods for remanufacturing existing spooling mechanisms of printer cartridges. Before describing one of the methods, the order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
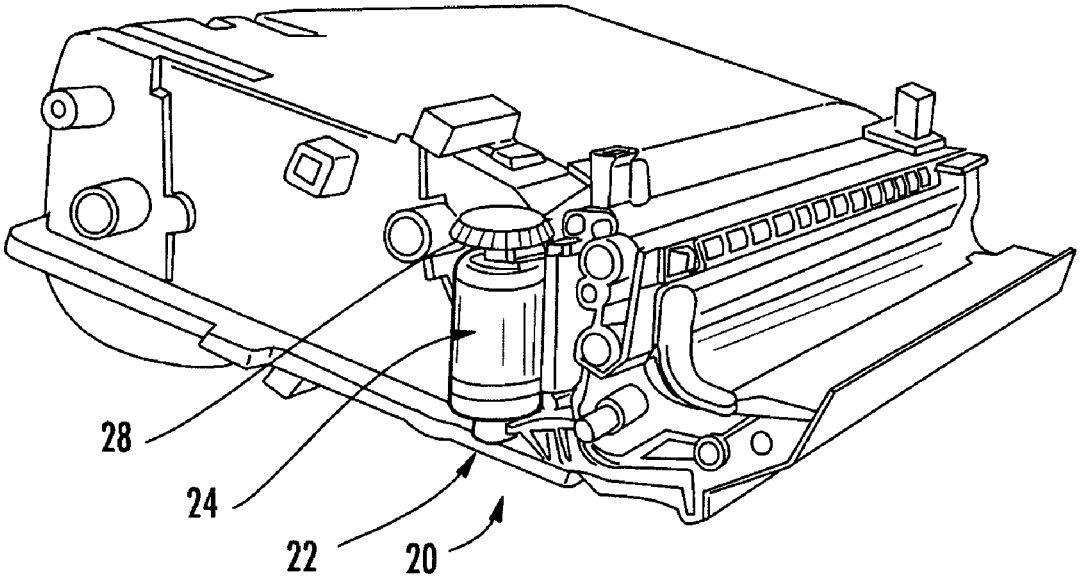
FIG. 1 is substantially a perspective view of a printer cartridge disassembled to provide access to the toner seal spooling mechanism.

Referring to FIG. 1, the first step may involve providing access to the seal spooling mechanism 20 by separating the toner hopper from the waste hopper and removing cartridge end caps on the toner hopper (not shown). Once the seal spooling mechanism 20 is accessible, it can be realized that the seal spooling mechanism 20 may include a spool 22 where a used toner seal 24 may be wound. The spool 22 is usually mounted to a spool frame 26, which holds and allows the spool 22 to rotate. The spool 22 may include a spool head 28, which may act as part of a gear that is configured to rotate with the end caps (not shown). The spool 22 is designed to operate such that when the printer cartridge is inserted in a printer, the end caps and the spool 22 will rotate, which in turn cause the toner seal 24 to wind around the body of the spool 22.

Figure 2:
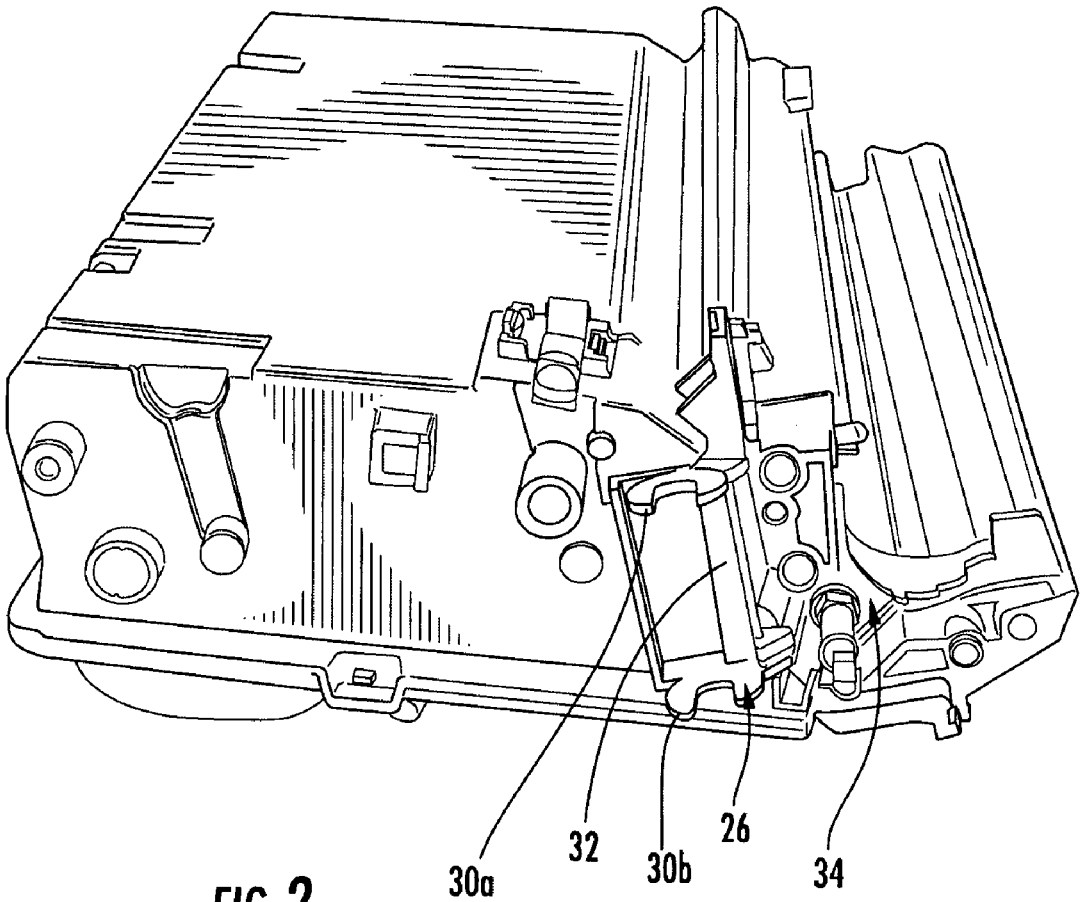
FIG. 2 is substantially a side view of the toner seal spooling mechanism of FIG. 1 with the spool detached.

As a subsequent step, the spool 22 may be manually detached from the spool frame 26. After the spool 22 is manually detached from the spool frame 26, a spool frame 26 is left on the printer cartridge. Referring now to FIG. 2, it can be appreciated that the spool frame 26 may include two opposing spool end holders 30*a* and 30*b*, which are joined by a bridge 32. The spool frame 26, spool end holders 30*a* and 30*b*, and bridge 32 are typically manufactured from one plastic mold with the drum roller assembly 34. Thus, they all form a single piece of material.

Figure 3:
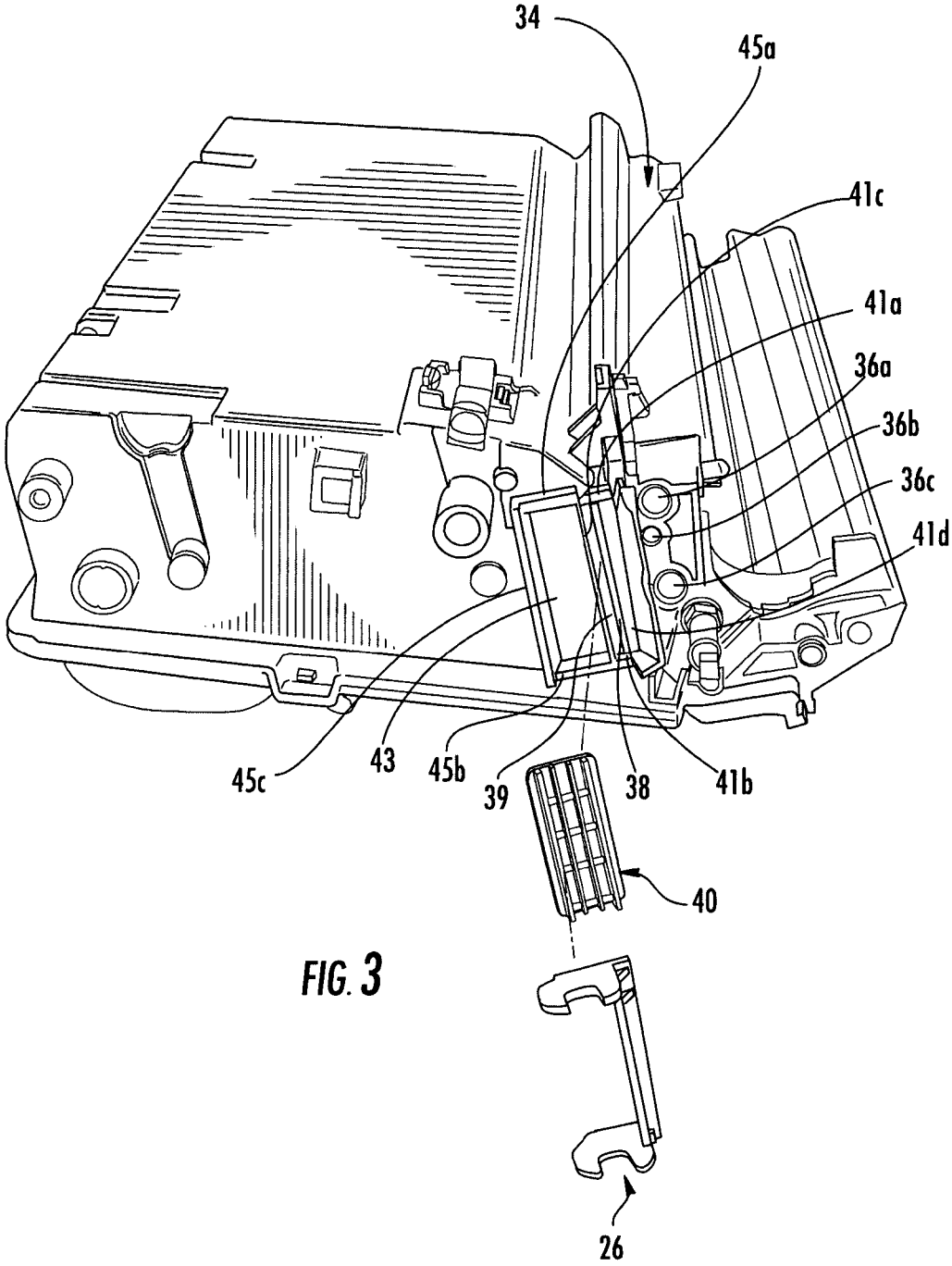
FIG. 3 is substantially an exploded view of the toner seal spooling mechanism of FIGS. 1 and 2 with the spool and seal entry plug having been removed and the spool frame having been cut out of the cartridge.

Next, with reference to FIG. 3, the spool frame 26 may be cut out of the drum roller assembly 34 at an area proximate to the end cap attachment holes 36*a*, 36*b*, and 36*c* preferably without altering the physical structures of the end cap attachment holes 36*a*, 36*b*, and 36*c*. It can be realized that after the removal of the spool frame 26, two compartments 39 and 43 may be visible on the printer cartridge, depending on the cartridge being remanufactured. For the HP4700 cartridge of Hewlett Packard, a first compartment 43 may be defined by walls 45*a, b,* and *c,* and 41*c*. The first compartment 43 may be rectangular in shape and may be used to hold a replacement spool frame discussed below. A second compartment 39 may be a seal entry compartment 39 defined by walls 41*a, b, c,* and *d*. The seal entry compartment 39 may define the seal passage 38 where a replacement seal may be introduced. The second compartment 39 may include a seal entry plug 40. The seal entry plug 40 may be removed from the inside of the seal passage 38 to open up the seal passage 38 for the installation of the replacement seal.

Figure 4:
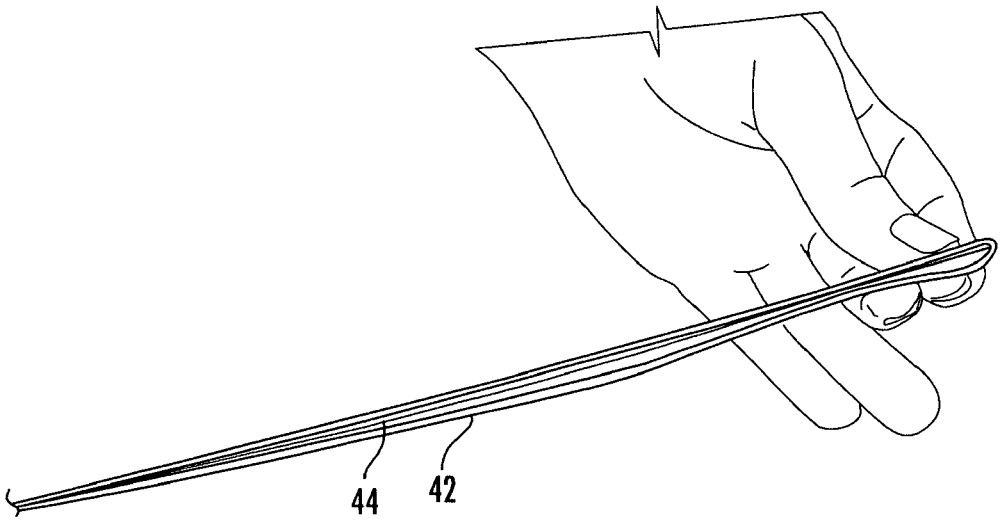
FIG. 4 is substantially a perspective view of a seal insertion tool with a replacement seal.

Referring to FIG. 4, a replacement seal 42 may be a flat piece of elongated plastic material. The replacement seal 42 may have one side with adhesive configured to fasten that side of the replacement seal 42 to the surfaces surrounding the toner port. The side opposite to the adhesive side that may not include any adhesive. The adhesive side may be covered with cover material that may be peeled to expose the adhesive. The replacement seal 42 may be positioned around a seal insertion tool 44 such that the length of the insertion tool (except for the handle) is covered by the replacement seal. The adhesive side of the replacement seal 42 may be positioned around the insertion tool such that when the insertion tool is inserted in the cartridge, the adhesive side is allowed to cover the toner port of the cartridge.

Figure 5:
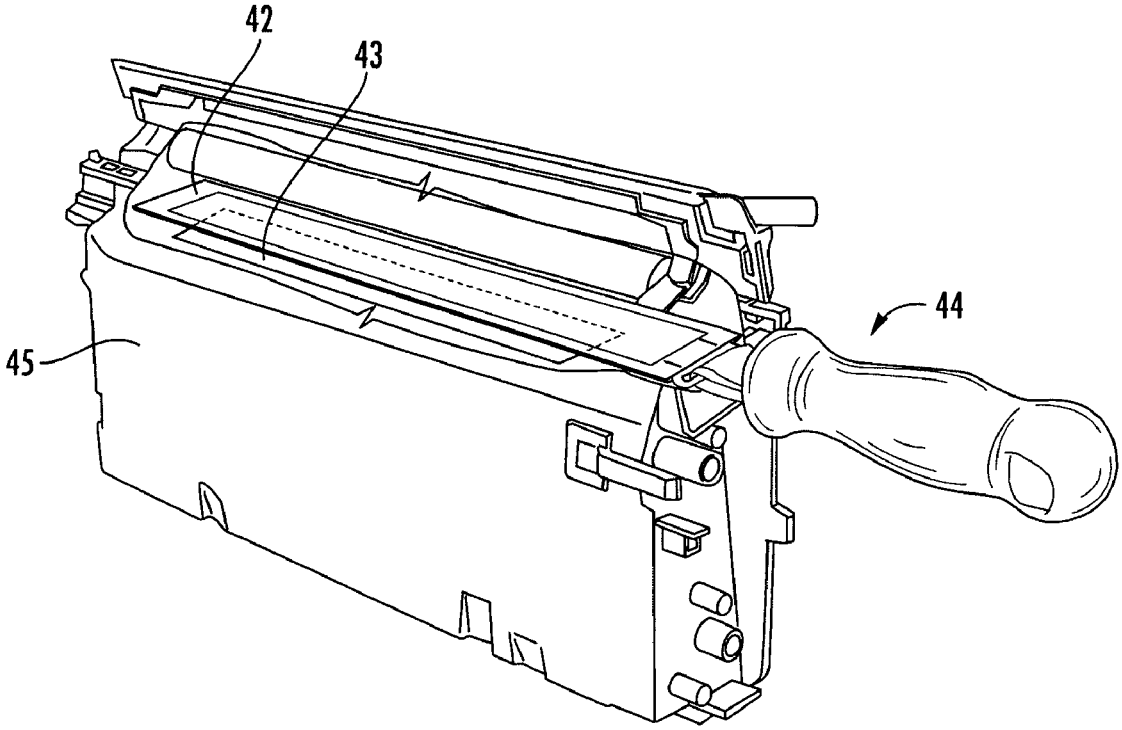
FIG. 5 is substantially a perspective view showing the attachment of the replacement seal to the cartridge using the seal insertion tool shown in FIG. 4.

When the tool 44 that is inserted through the seal passage 38 reaches the end of the seal passage 38 (FIG. 5), the cover material of the replacement seal may be peeled, and the tool may be pressed against the toner hopper 45 to allow the adhesive of the replacement seal 42 to adhere to the surfaces surrounding the toner port 43 thereby allowing the replacement seal to close the toner port 43. The tool 44 may then be withdrawn from the seal passage 38 leaving the replacement seal 42 therein.

Figure 6:
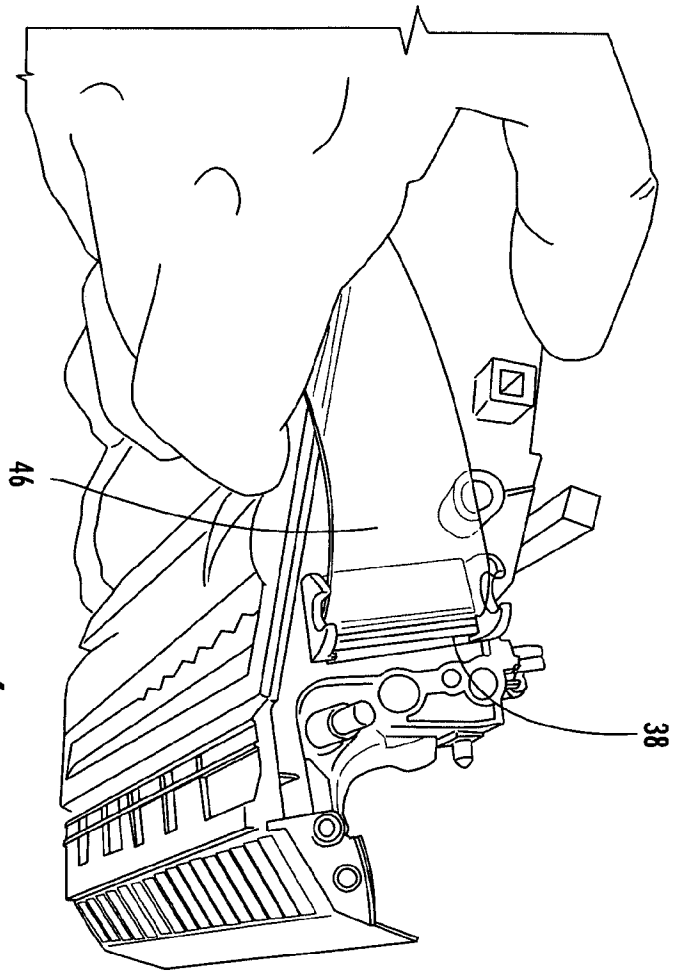
FIG. 6 is substantially a side view of the cartridge shown in FIG. 4 with the seal plug reattached and the seal extension hanging out of the seal passage.
Figure 7:
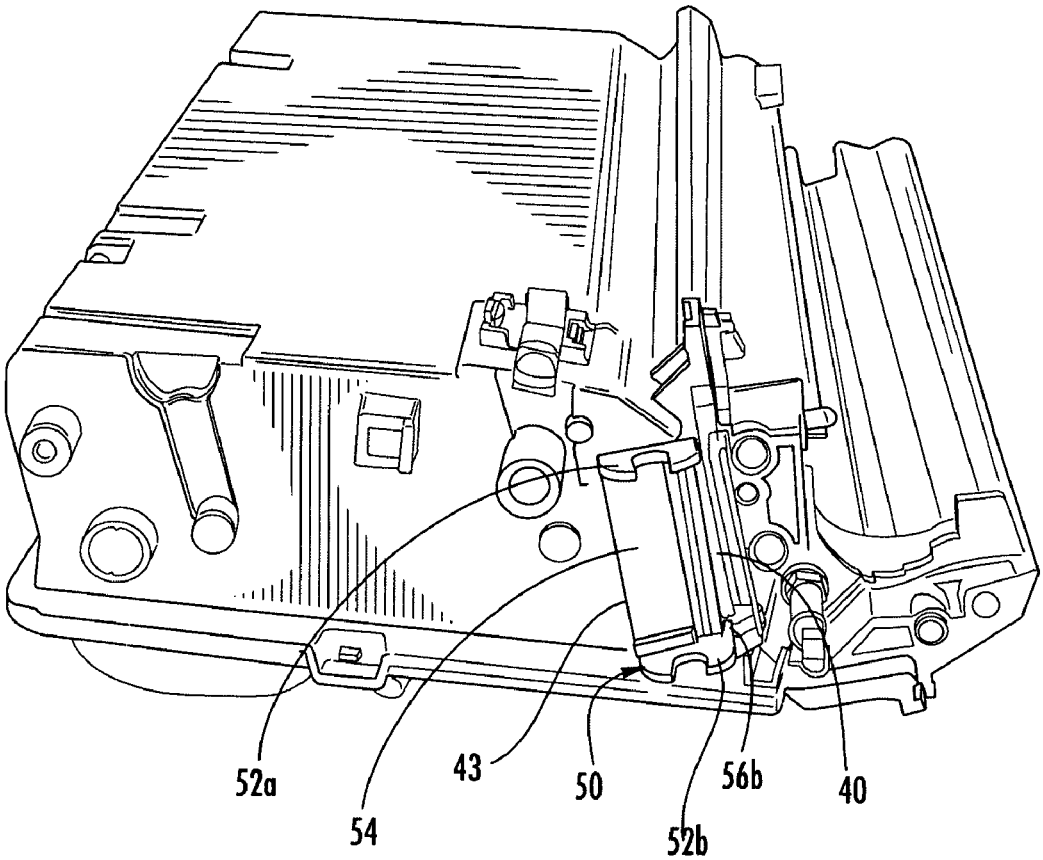
FIG. 7 is substantially a side view of the cartridge with the spool frame shown in FIG. 6 with the seal extension removed for the purpose of showing the details of the spool frame.

The replacement seal 42 preferably includes a length 46 that extends out of the seal passage 38 when the replacement seal 42 has been inserted (hereinafter "extending seal portion") (FIG. 6). The extending seal portion 46 may be allowed to hang outside the seal passage 38. The seal passage 38 may then be closed by inserting therein either the existing seal entry plug 40 or a new seal entry plug 40 (FIG. 7). The seal entry plug 40 may be made of flexible rubber material capable of snugly fitting within the seal passage 38 and may utilize friction to secure itself within the seal passage 38.

A base 54 of a replacement spool frame 50 is preferably fastened to the first compartment 43. The replacement spool frame 50 preferably includes a pair of spool holders 52*a* and 52*b*. Each spool holder 52*a* or 52*b* may be substantially U-shaped to accommodate the cylindrical body of the spool 22 (not shown). The U-shaped structure of each spool holder 52*a* or 52*b* may be designed to rotatably hold the cylindrical body of the spool 22. Each spool holder 52*a* or 52*b* are preferably attached to a base 54. The base 54 may include a predetermined length configured to separate spool holder 52*a* or 52*b* at a distance that would allow the spool 22 to properly wind the seal 24 (not shown). The length of the base 54 may also be predetermined to snugly fit within the first compartment 43.

Figure 8:
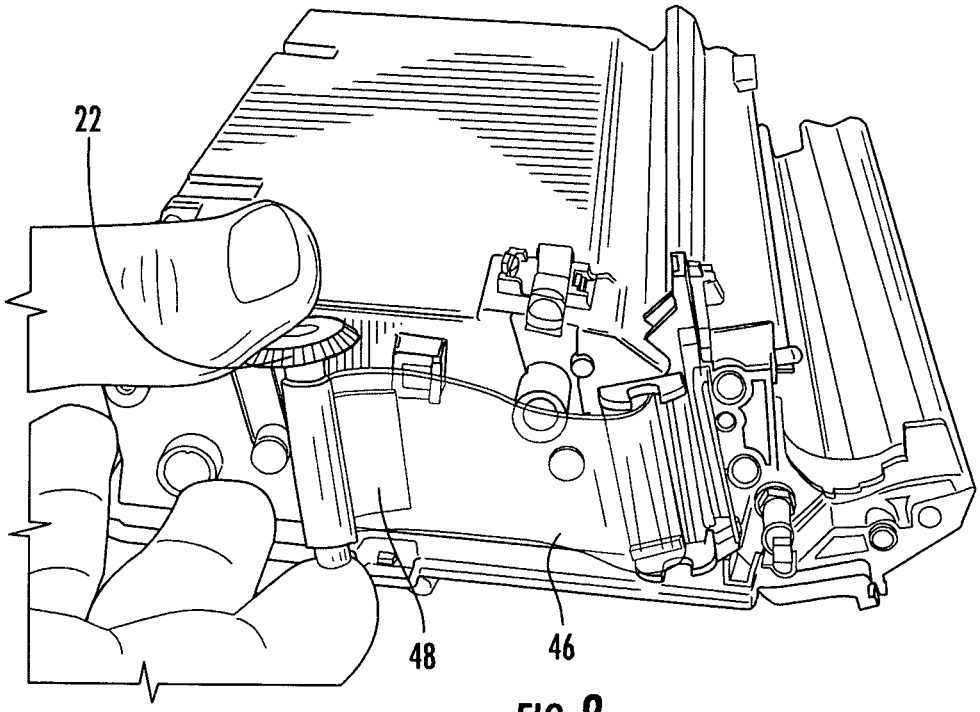
FIG. 8 is substantially a side view of the cartridge with the replacement seal being attached to the spool.

Referring now to FIG. 8, the extending seal portion 46 is preferably wrapped around the spool 22. A piece of adhesive tape 48 may be attached to the end of the extending seal portion 46 and to the spool 22 to attach the extending seal portion 46 to the spool 22. The rest of the extending seal portion 46 may then be wrapped around the spool 22 by rotating the spool 22 until the extending seal portion 46 wrapped around the spool 22 is substantially tight. The spool 22 may then be attached to the spool holders 52*a* and 52*b* of the replacement spool frame 50.

It can now be realized that the present invention provides a method of remanufacturing toner seal spooling mechanisms of printer cartridges from original equipment manufacturers (OEMs). The remanufacturing method of the present invention allows the seals of automatic spooling mechanisms of printer cartridges to be replaced while maintaining the ability to spool the seals effectively and automatically upon the insertion of the printer cartridges to proper printers. It is noted that the remanufacturing method of the present invention is not limited to being implemented in the remanufacturing environment. The method of the present invention may be utilized in manufacturing toner seal spooling mechanisms and may be implemented by the OEMs.

It can further be realized that the present invention also provides an alternate spool frame for existing toner seal spooling mechanisms. As shown in FIG. 7, the alternate spool frame 50 may be attached on a printer cartridge at a location that is different from the location where the spool frame of the OEMs is attached. Additionally, unlike the spool frame of the OEMs, the alternate spool frame 50 does not substantially block the seal entry passage 38. The attachment of the spool frame holders 52*a* and 52*b* to the base 54 helps the alternate spool frame 50 provide these benefits.

Figure 9:
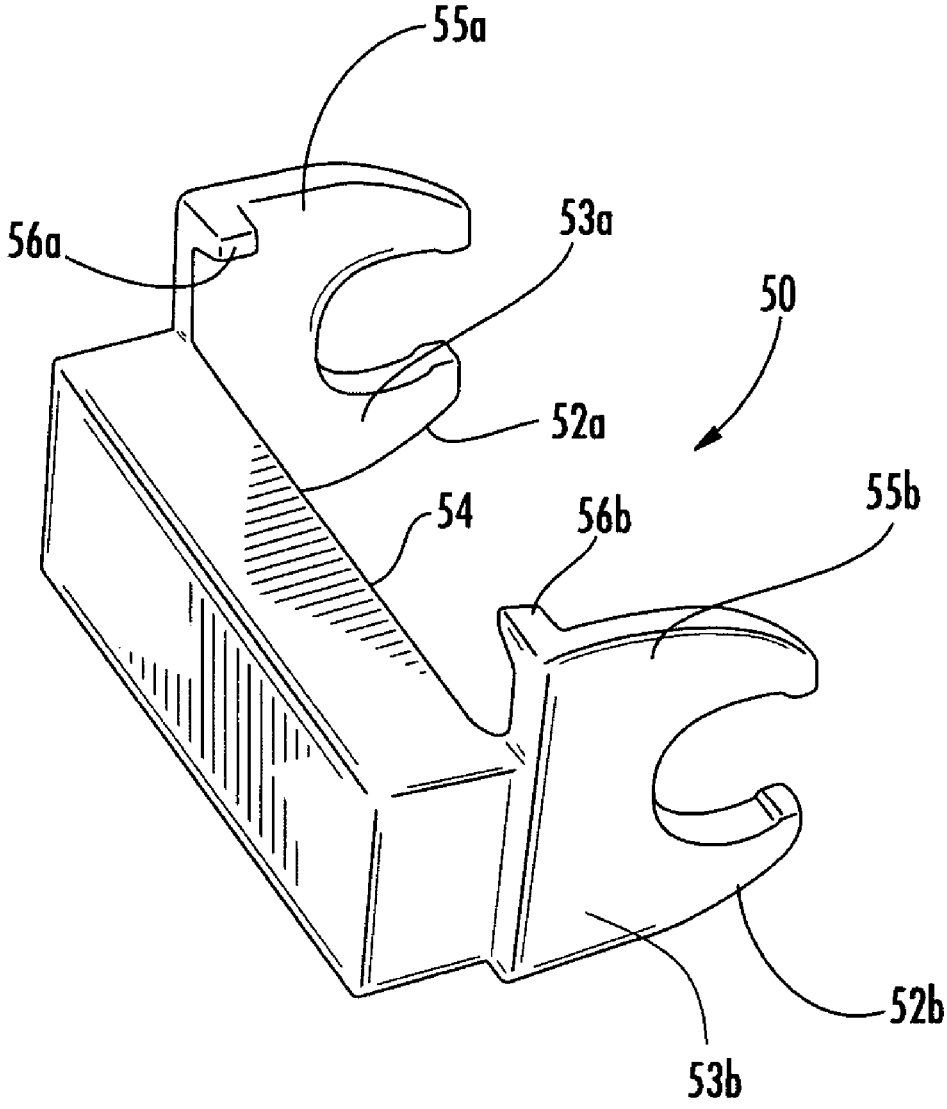
FIG. 9 is substantially a perspective view of a spool frame of the present invention.

Referring now to FIG. 9, the alternate spool frame 50 preferably includes spool frame holders 52*a* and 52*b* that are only partially attached to a base 54. Each spool frame holder 52*a* and 52*b* preferably include its respective base side 53*a*, 53*b* and free side 55*a*, 55*b*. The base 54 is preferably attached to the base side of the spool frame holders 52*a* and 52*b*. The base 54 is preferably not attached to the free side of the spool frame holders 52*a* and 52*b*. The base 54 is preferably made of substantially thick material that may have a substantially flat bottom 57. The substantially thick base with flat bottom 57 may provide a sturdy point of attachment for the alternate spool frame 50. Thus, it can be realized that the present invention may provide a sturdy spool frame that may ensure longer lasting spool operation than conventional remanufacturing methods.

A pair of projections 56*a* and 56*b* may be attached to each free side of the spool frame holders 52*a* and 52*b*. The pair of projections 56*a* and 56*b* is preferably designed to serve as stop devices for the seal entry plug 40. That is, the seal entry plug 40 may abut against the pair of projections 56*a* and 56*b* thereby remain secured within the seal passage 38 (FIG. 7). It can therefore be appreciated that the methods and devices of the present invention may provide additional safeguards against toner leaks during shipment and handling.

Although the description above contains many specifications, these should not be construed as limiting the scope of the invention but as merely providing illustrations of some of the presently preferred embodiments of this invention. For example, the sizes and intended position of the replacement spool frame on the printer cartridge may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A method of remanufacturing a seal spooling mechanism of a printer cartridge, the printer cartridge defining a seal passage, the seal passage providing access to a toner port of the printer cartridge to be covered by a toner seal, the seal spooling mechanism comprising a spool where a first toner seal may be wound, the seal spooling mechanism further comprising a spool frame where the spool may be mounted, the method comprising:

a. detaching the spool frame from the printer cartridge;

b. inserting a second toner seal through the seal passage;

c. sealing the toner port with the second toner seal, the second toner seal comprising a toner seal extension configured to extend out of the seal passage upon sealing the toner port;

d. winding the toner seal extension around the spool;

e. providing a replacement spool frame, the replacement spool frame being configured to be attached to the printer cartridge at a location that is different from the location where the spool frame was previously attached on the printer cartridge; and f. attaching the spool to the replacement spool frame.

2. The method of claim 1, further comprising detaching the spool with the first toner seal from the spool frame.

3. The method of claim 1, further comprising providing a seal insertion tool and using the seal insertion tool to seal the toner port with the second toner seal.

4. The method of claim 1, wherein the seal passage comprises a seal passage plug, the method further comprising removing the seal passage plug.

5. The method of claim 4, further comprising replacing back the seal passage plug.

6. The method of claim 4, further comprising replacing back the seal passage plug, the plug being positioned within the seal passage, providing a plug stop attached to the replacement spool frame, and positioning the plug stop adjacent to the seal passage plug thereby securing the plug within the seal passage.

7. The method of claim 1, further comprising providing a plug stop attached to the replacement spool frame.

8. The method of claim 1, further comprising attaching the toner seal extension to the spool.

9. A method of minimizing leakage of toner stored in a printer cartridge, the printer cartridge comprising a toner hopper configured to store the toner, the toner hopper defining a toner port, the printer cartridge defining a seal passage substantially adjacent to and leading to the toner port, the method comprising:

a. providing a seal configured to surround the toner port;

b. inserting the seal through the seal passage;

c. providing a spool, the spool comprising a body around which the seal may be wound;

d. attaching the seal to the spool;

e. positioning a seal entry plug inside the seal passage;

f. attaching a spool frame to the printer cartridge, the spool frame configured to rotatably hold the spool, the spool frame comprising at least one seal plug stop;

g. positioning the seal plug stop proximate to the seal entry plug;

h. attaching the spool to the spool frame; and i. configuring the spool to rotate and wind the seal when the printer cartridge is inserted in a predetermined printer, wherein the seal entry plug and the seal minimizes the toner from exiting the printer cartridge.

10. The method of claim 9, wherein the spool frame comprises a pair of spool holders and a base attached to the pair of spool holders.

11. The method of claim 10, wherein when the base of the spool frame is attached to the printer cartridge, the seal passage remains accessible.

12. The method of claim 9, wherein when the spool frame is attached to the printer cartridge, the seal passage remains accessible.

13. A spool frame for toner seal spooling mechanisms of printer cartridges, the toner seal spooling mechanism having a spool where a toner cartridge seal may be wound, the spool comprising a spool body, the spool body defining a first end and a second end, the spool frame comprising:

a. a first end holder configured to hold the first end of the spool body, the first end holder defining a base side and a free side;

b. a second end holder configured to hold the second end of the spool body; the second end holder defining a base side and a free side; and c. a spool frame base connecting the first end holder and the second end holder, the spool frame base being attached to the first end holder and the second end holder at the base sides of the first end holder and the second end holder, the spool frame base not being attached to the free sides of the first end holder and the second end holder, wherein when the spool frame is attached to the printer cartridge, the seal may be pulled out of the printer cartridge.

14. The spool frame of claim 13, further comprising a first seal plug stop attached to the free end of the first end holder, the first seal plug stop forming a projection from the first end holder, the first seal plug stop being configured to be positioned adjacent to a seal plug when the spool frame is attached to the printer cartridge to prevent the seal plug from exiting the printer cartridge.

15. The spool frame of claim 13, further comprising a second seal plug stop attached to the free end of the second end holder, the second seal plug stop forming a projection from the second end holder, the second seal plug stop being configured to be positioned adjacent to a seal plug when the spool frame is attached to the printer cartridge to prevent the seal plug from exiting the printer cartridge.

16. The spool frame of claim 13, wherein the base is positioned below the first end holder and the second end holder.

17. The spool frame of claim 13, wherein the base is configured to be snugly fitted to a printer cartridge portion.

* * * * *